US010286246B2

(12) United States Patent
Doyle

(10) Patent No.: US 10,286,246 B2
(45) Date of Patent: May 14, 2019

(54) FRAME FOR GLUTEUS MAXIMUS EXERCISE DEVICE

(71) Applicant: Dennis Doyle, Santa Monica, CA (US)

(72) Inventor: Dennis Doyle, Santa Monica, CA (US)

( * ) Notice: Subject to any disclaimer, the term of this patent is extended or adjusted under 35 U.S.C. 154(b) by 0 days.

(21) Appl. No.: 16/159,742

(22) Filed: Oct. 15, 2018

(65) Prior Publication Data

US 2019/0046827 A1 Feb. 14, 2019

Related U.S. Application Data

(62) Division of application No. 16/019,870, filed on Jun. 27, 2018.

(60) Provisional application No. 62/526,698, filed on Jun. 29, 2017.

(51) Int. Cl.

| | |
|---|---|
| ***A63B 21/008*** | (2006.01) |
| ***A63B 21/00*** | (2006.01) |
| *A63B 21/16* | (2006.01) |
| *A63B 23/035* | (2006.01) |

(52) U.S. Cl.

CPC .... *A63B 21/0085* (2013.01); *A63B 21/00069* (2013.01); *A63B 21/008* (2013.01); *A63B 21/00047* (2013.01); *A63B 21/00058* (2013.01); *A63B 21/16* (2013.01); *A63B 21/169* (2015.10); *A63B 21/1681* (2013.01); *A63B 23/03508* (2013.01)

(58) Field of Classification Search

CPC ..... A63B 21/00069; A63B 21/00047; A63B 21/00058; A63B 21/0085; A63B 21/169; A63B 21/16; A63B 21/1681; A63B 23/03508

See application file for complete search history.

(56) References Cited

U.S. PATENT DOCUMENTS

| | | | | |
|---|---|---|---|---|
| 3,920,240 A * | 11/1975 | Ross | A63B 21/00047 182/108 |
| 6,695,754 B1 * | 2/2004 | Gazzolo | A63B 23/12 482/141 |
| 7,309,305 B2 * | 12/2007 | Nichols | A63B 21/00047 482/148 |
| 2016/0082313 A1 * | 3/2016 | MacColl | A63B 23/0211 482/140 |
| 2017/0296866 A1 * | 10/2017 | Paquin | A63B 21/00047 |

* cited by examiner

*Primary Examiner* — Megan Anderson

(74) *Attorney, Agent, or Firm* — Joseph E. Maenner; Maenner & Associates, LLC

(57) ABSTRACT

A stand for an exercise device includes a generally planar body, a first leg extending downwardly from the body, and a second leg extending downwardly from the body. A first extension extends upwardly from the body and a second extension extends upwardly from the body.

18 Claims, 12 Drawing Sheets

FRAME FOR GLUTEUS MAXIMUS EXERCISE DEVICE

CROSS-REFERENCE TO RELATED APPLICATION

The present invention is a divisional application of U.S. patent application Ser. No. 16/019,870, filed on Jun. 27, 2018 (allowed), which claims priority from U.S. Provisional Patent application Ser. No. 62/526,698, filed on Jun. 29, 2017, both of which are incorporated herein by reference in their entireties.

BACKGROUND OF THE INVENTION

Field of the Invention

The present invention relates to exercise equipment. Specifically, the present invention is a device that facilitates targeted exercise of the gluteus maximus muscles.

Description of the Related Art

Exercise is key for the health of an individual. There are many different muscles in the human body and a number of different workouts that target each muscle. However, workouts typically do not target a specific muscle, but rather a group of different muscles. Workouts that target the gluteus maximus often exercise other leg muscles more. There exists a need for an invention that can target the gluteus maximus where the gluteus maximus is the main muscle of focus.

SUMMARY OF THE INVENTION

This summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is an exercise device that allows a person to focus their exercise efforts on the gluteus maximus muscles. The device holds a modified air pump in position against a wall or other vertical surface while a user presses on the pump with a foot from various positions. The pump is modified with an insert that restricts the flow of air with selectable resistance to provide an adjustable level of exercise intensity. The device also contains a clasp for holding the exercise device in a depressed position so that the device remains depressed for convenient storage.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
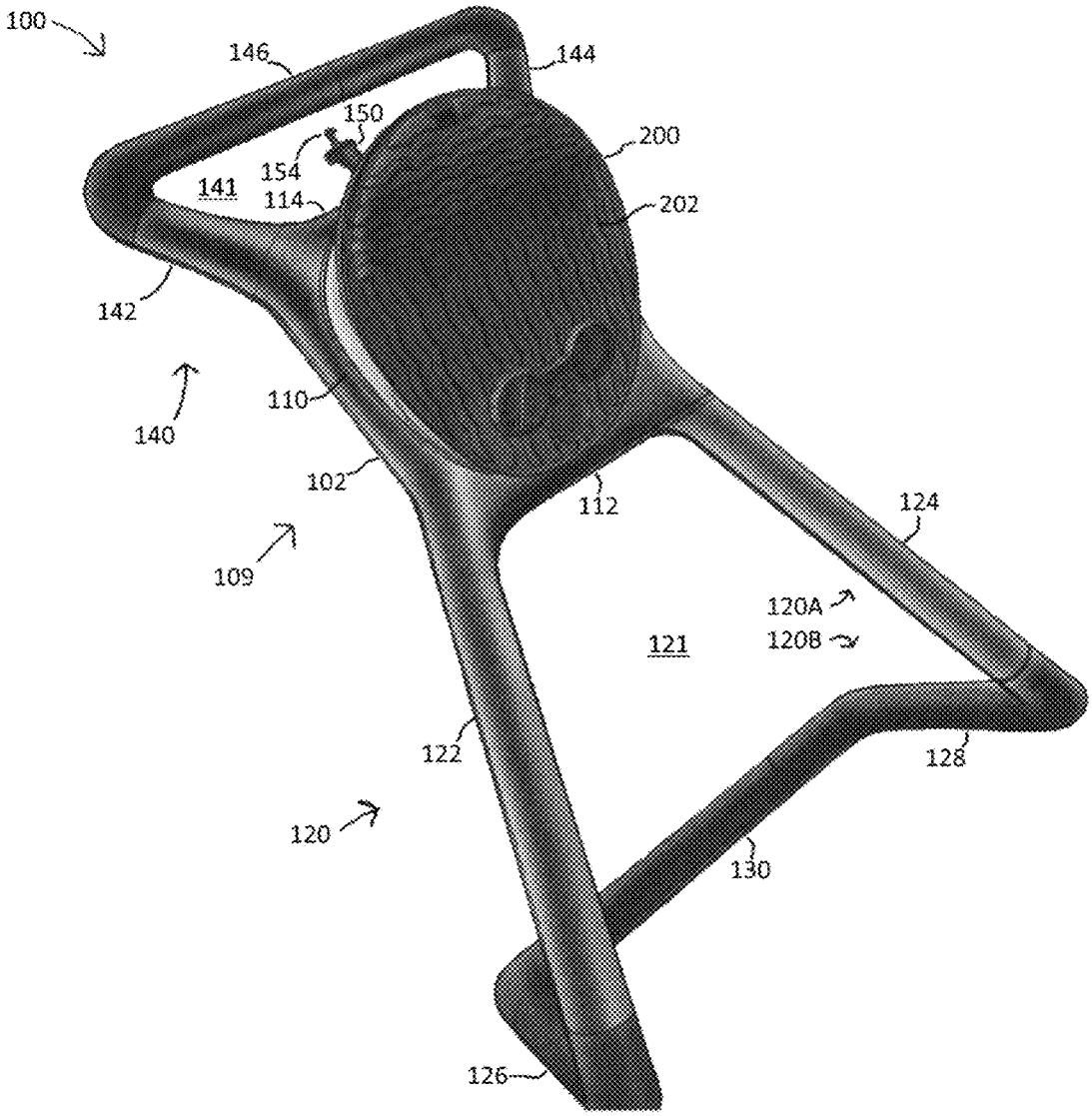
FIG. 1 is a perspective view of an exemplary embodiment of an exercise device according to the present invention.
Figure 2:
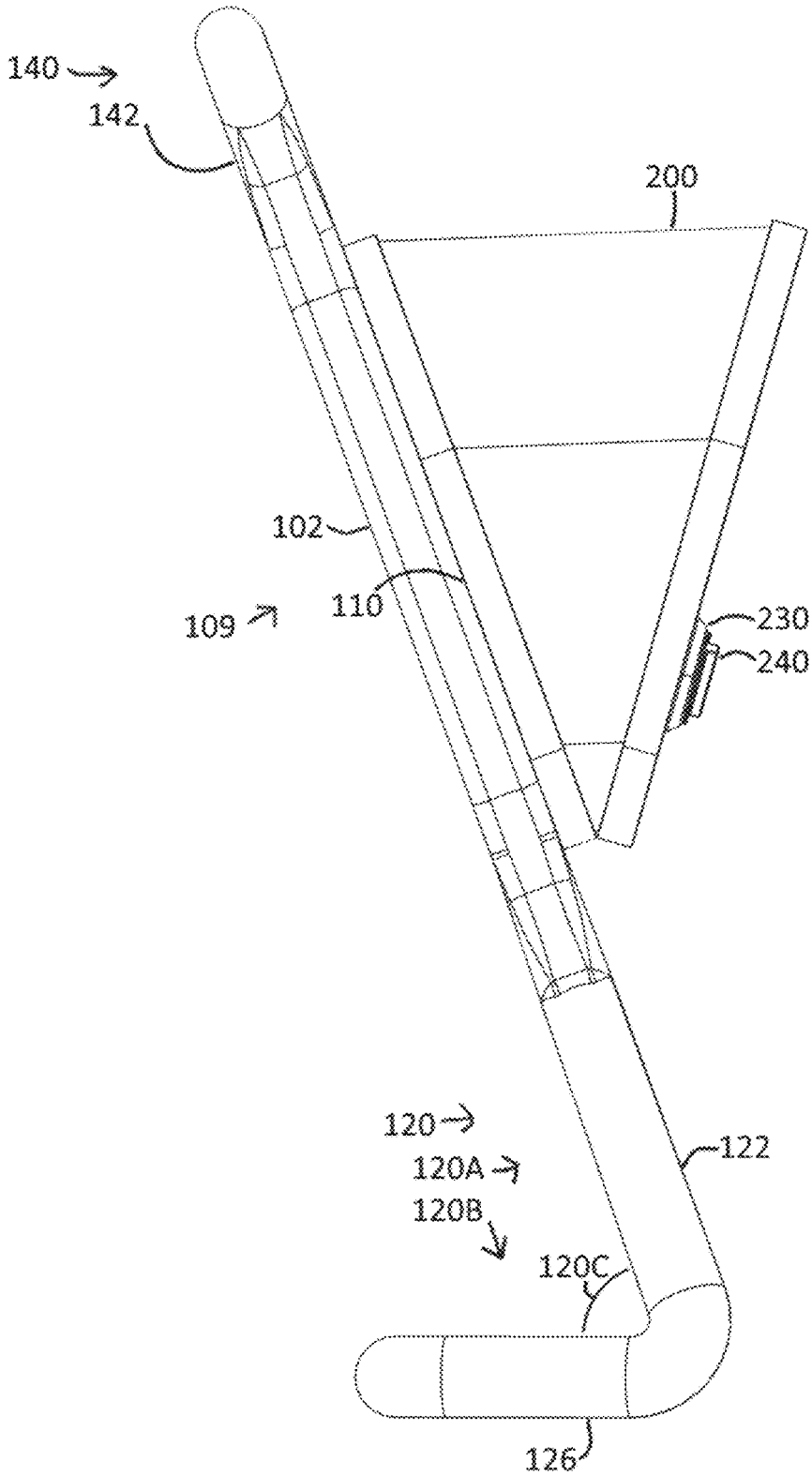
FIG. 2 is a left side view of the exercise device of FIG. 1.
Figure 3:
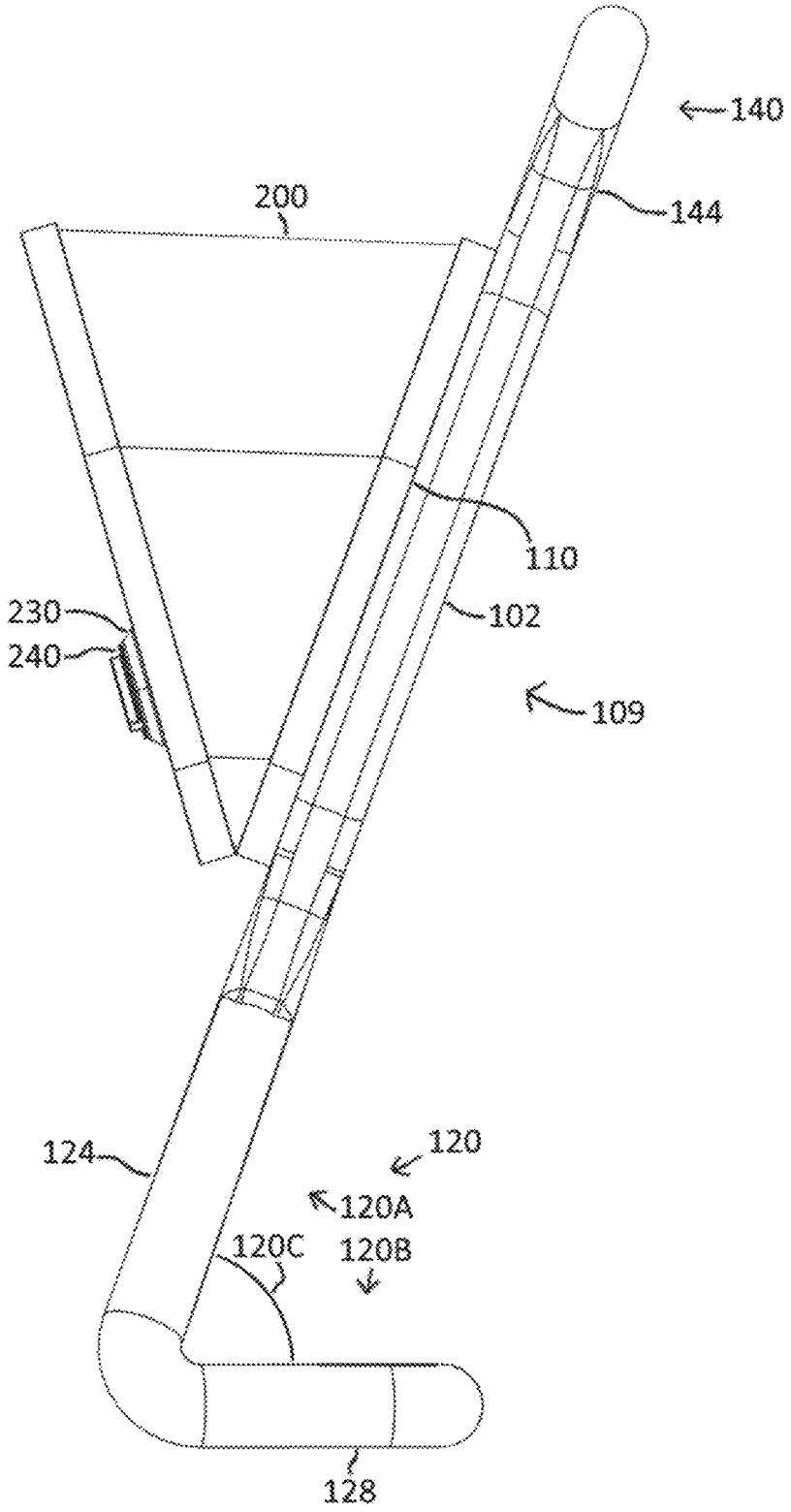
FIG. 3 is a right side view of the exercise device of FIG. 1.
Figure 4:
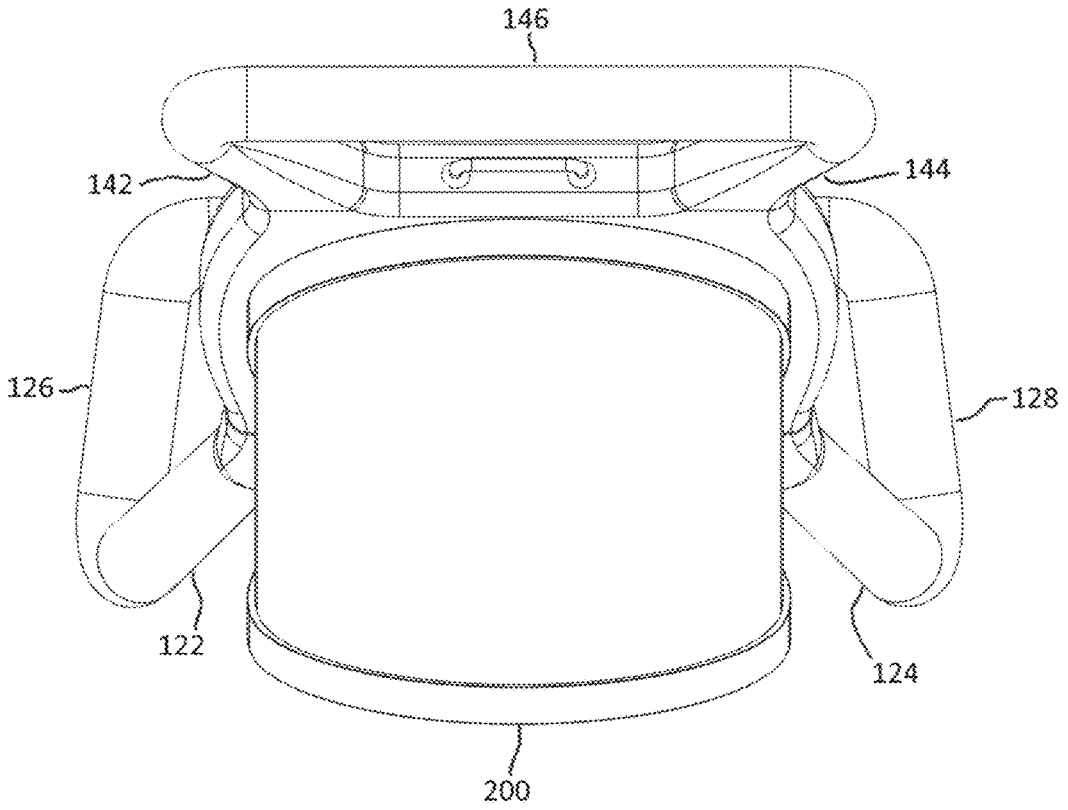
FIG. 4 is a top plan view of the exercise device of FIG. 1.
Figure 5:
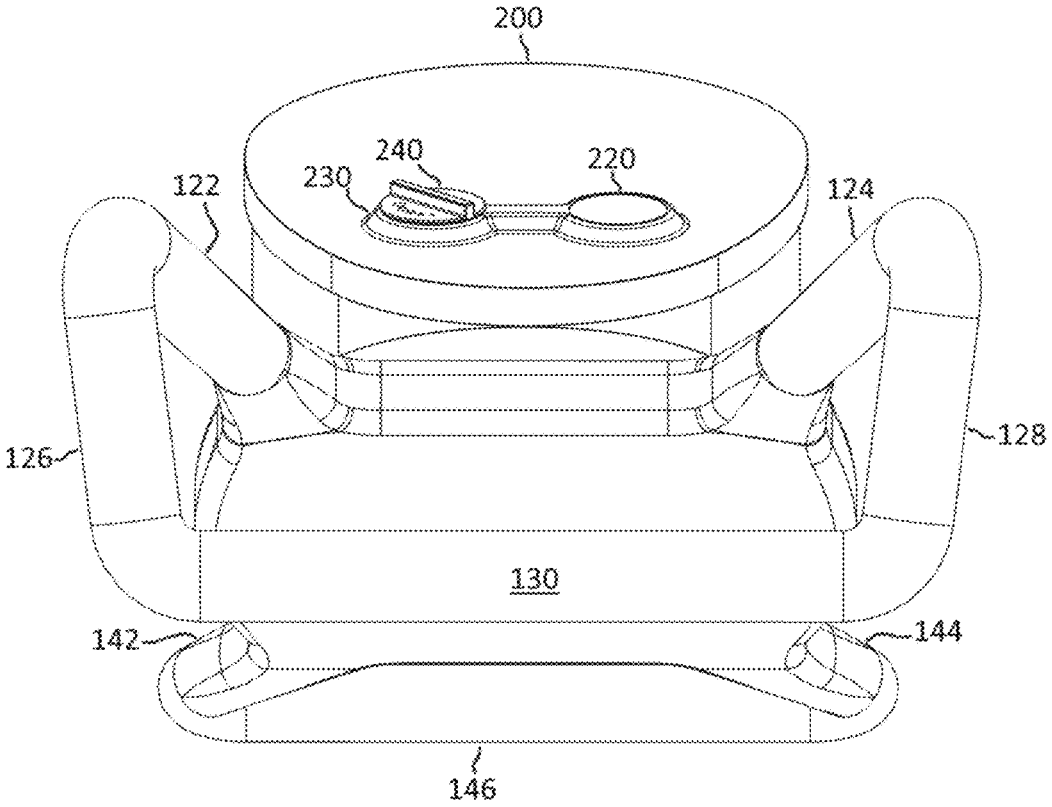
FIG. 5 is a bottom plan view of the exercise device of FIG. 1.
Figure 6:
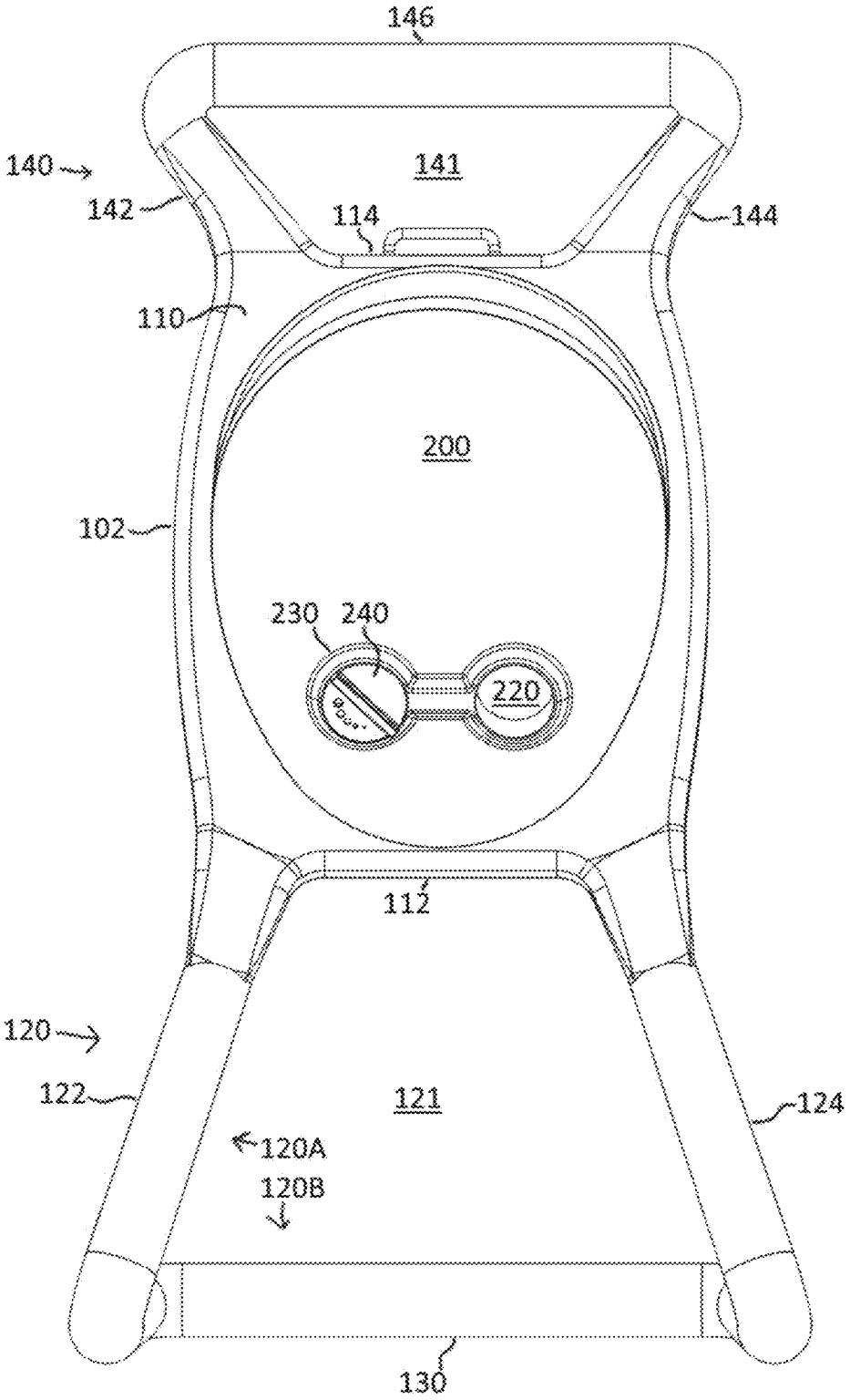
FIG. 6 is a front elevational view of the exercise device of FIG. 1.
Figure 7:
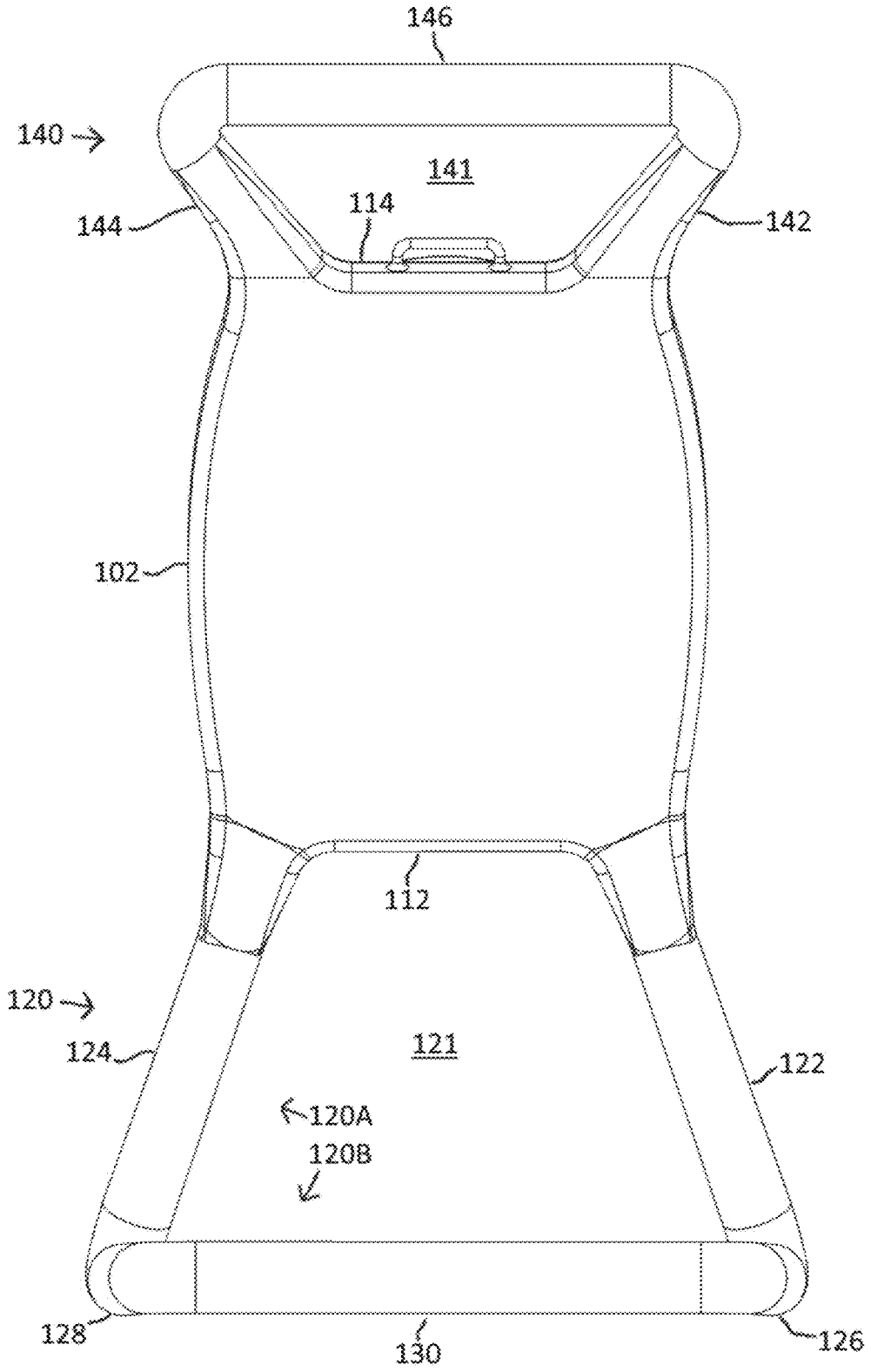
FIG. 7 is a rear elevational view of the exercise device of FIG. 1.

In the drawings, like numerals indicate like elements throughout. Certain terminology is used herein for convenience only and is not to be taken as a limitation on the present invention. The terminology includes the words specifically mentioned, derivatives thereof and words of similar import. As used herein, the term "distal" is defined as a distance away from a device's center, and the term "proximal" is defined as a distance close to the device's center.

The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Referring to FIG. 1-8, an exemplary embodiment of an exercise device 100 according to the present invention is shown. The exercise device 100 includes a stand 102 with a generally planar body 109 having an attachment face 110 and a central longitudinal axis 104. A mechanical resistance device in the form of a bellows 200 is attached to the attachment face 110.

The longitudinal axis 104 intersects a body first side 112 and a body second side 114. On the first side 112, the body 109 is supported by an attached base 120. The base 120 extends away from the body 109, generally parallel to the attachment face 110. The base 120 is bent, forming a proximal section 120A and a distal section 120B connected at an acute angle 120C. In an exemplary embodiment, angle 120C can be 70 degrees, although those skilled in the art will recognize that angle 120C can be other values. The stand 120 can include a void 121 formed therein, with the residual material forming a first proximal leg 122 connected at the angle 120C to a first distal arm 126, and a second proximal leg 124 connected at the angle 120C to a second distal arm 128. The proximal legs 122, 124 extend generally co-planar with the body 109. The first distal arm 126 is connected to the second distal arm 128 by a connector piece 130 wherein the first distal arm 126, the second distal arm 128, and the connector piece 130 form a generally U-shaped connector portion.

An extension 140 is attached to the second side 114 of the body 109 and extends generally coplanar to the attachment face 110. The extension 140 can include a void 141, with the residual material forming a first extension arm 142 and a second extension arm 144 connected to each other by a handle 146.

The distal section 120B has a length which is long enough to allow the exercise device 100 to rest upright on the stand 120, but short such that, when the handle 146 engages a vertical surface, the connector piece 130 is spaced away from the vertical surface.

Figure 11:
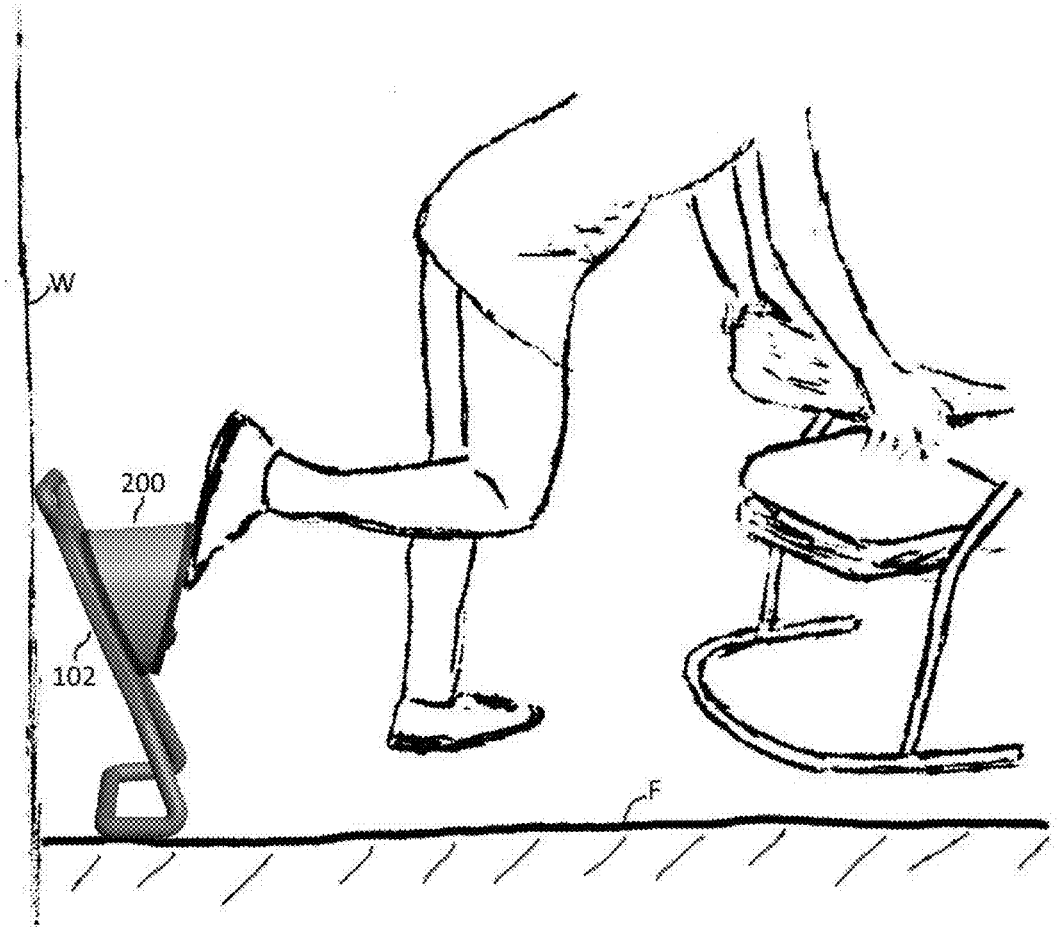
FIG. 11 shows a person using the exercise device of FIG. 1 while standing.
Figure 12:
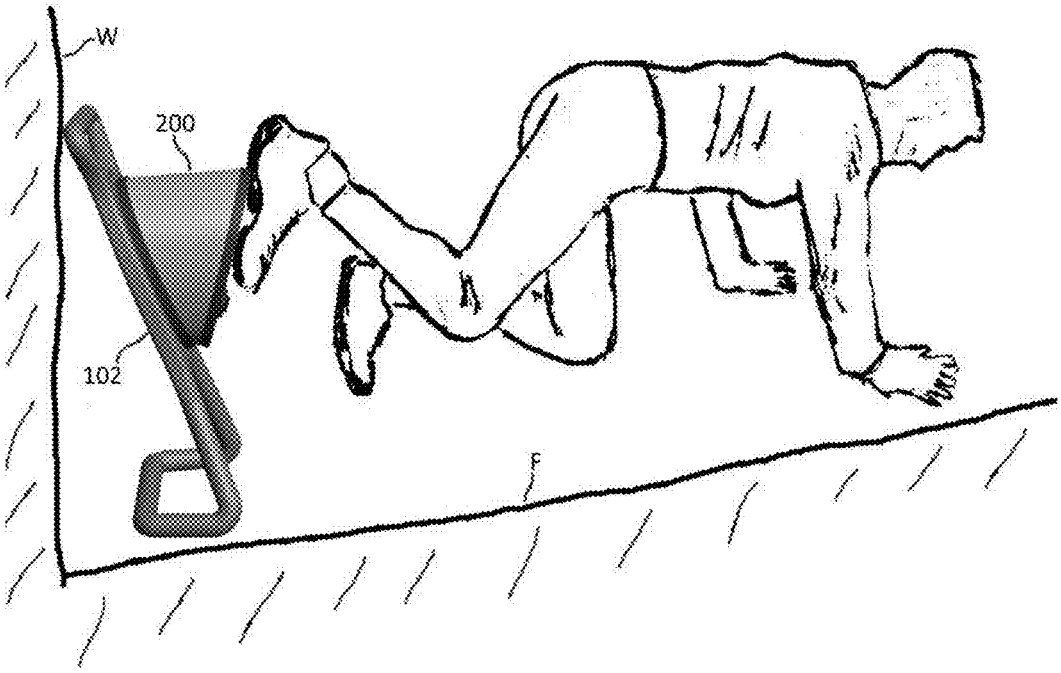
FIG. 12 shows a person using the exercise device of FIG. 1 while crouched.
Figure 13:
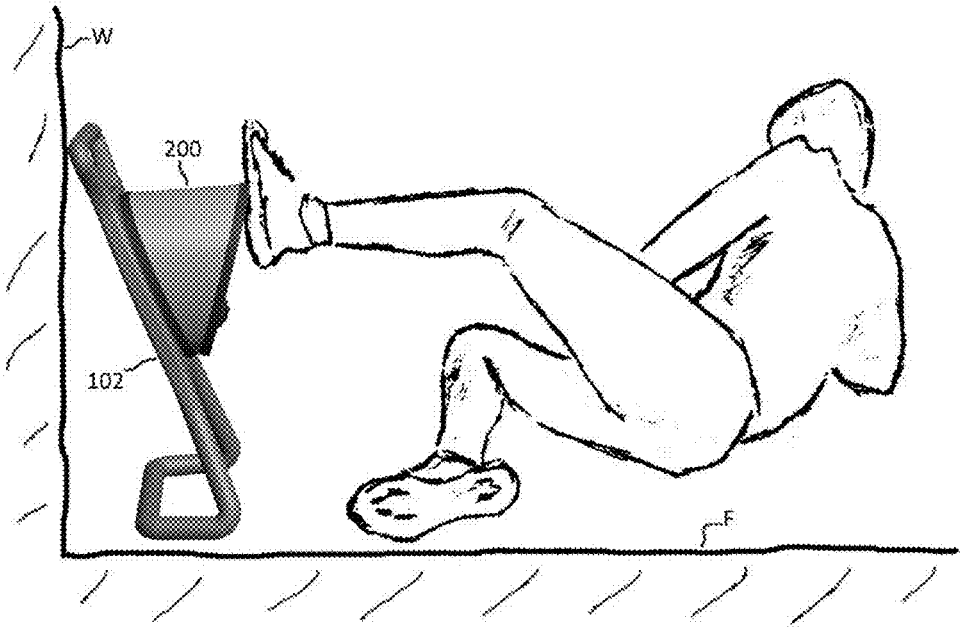
FIG. 13 shows a person using the exercise device of FIG. 1 while laying down.

Thus, as shown in FIG. 11-13, the exercise device 100 can be placed on a floor "F" and rested securely against a vertical surface, such as a wall "W" with the handle 146 in contact with the wall W to prevent movement of the device 100 while in use as a person pushes against the exercise device 100.

A non-skid material, such as for example, rubber, can be affixed to the stand 120 and to the extension 140 to increase frictional resistance of device 100 with respect to the floor F and the wall W to reduce the likelihood of device 100 slipping while in use.

Figure 8:
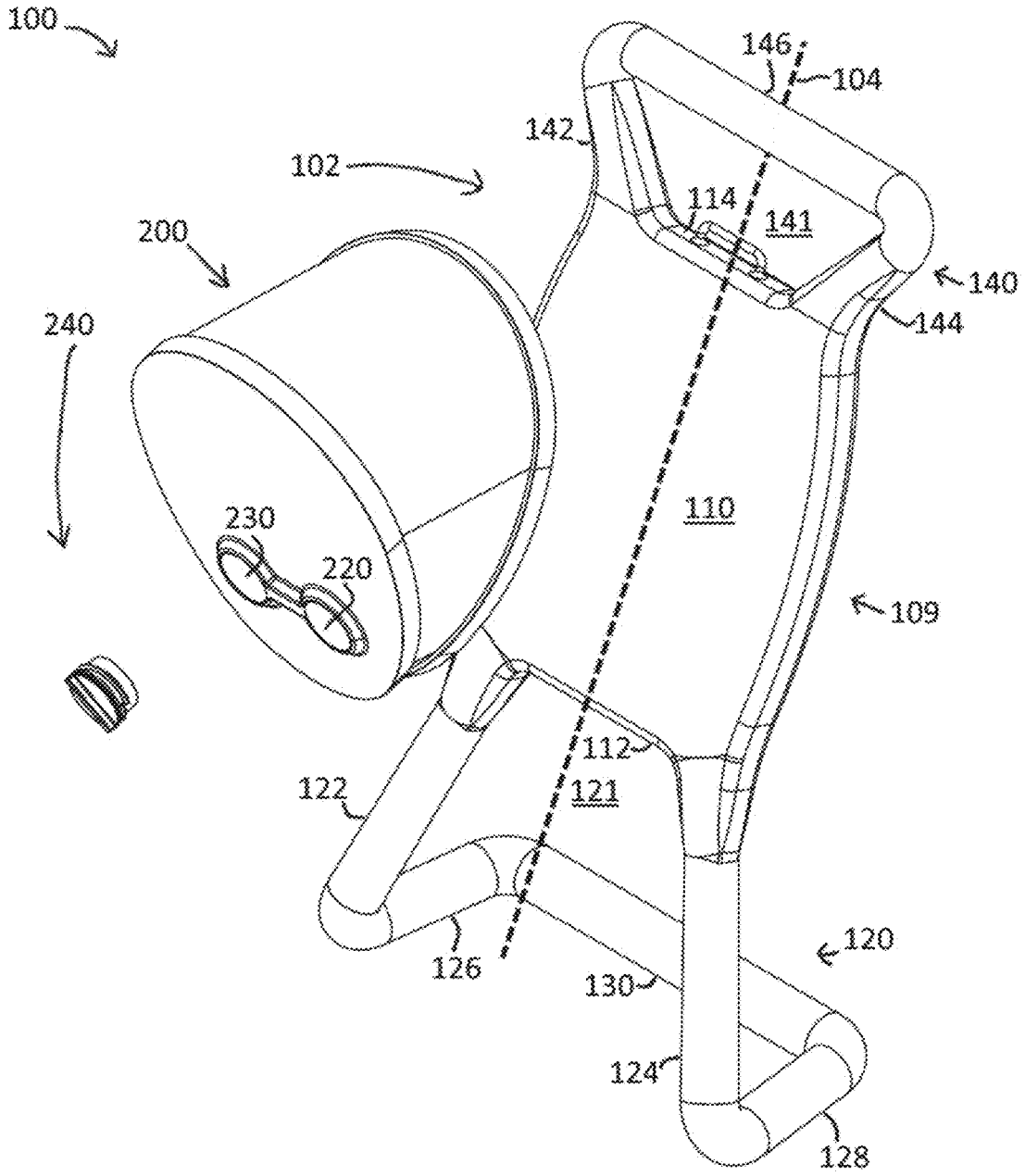
FIG. 8 is an exploded perspective view of the exercise device of FIG. 1.
Figure 9:
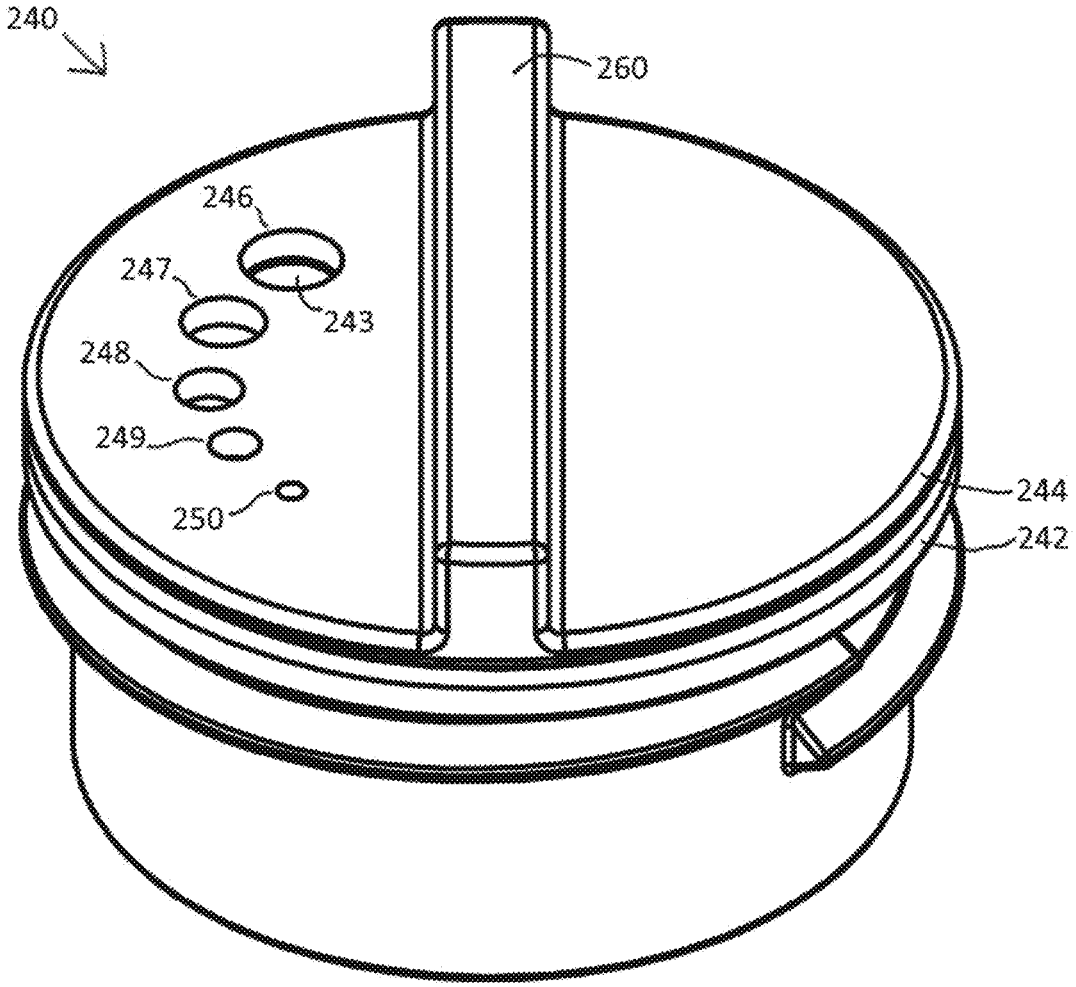
FIG. 9 is a perspective view of a plug and cap used with the exercise device of FIG. 1.

Foot-operated bellows pumps are known and are sold at retail stores for inflating various sporting equipment. One such pump having a one-way inlet valve 220 and an output hole 230 can be used with device 100 and is retrofitted as follows:

A 2-way flow restrictor 240, detailed in FIG. 9, is inserted into the output hole 230 (shown in FIG. 8). The flow restrictor 240 comprises a plug 242 and a cap 244. The plug 242 is formed with a plug hole 243 that allows for the flow of fluid out of the bellows pump 200 as the bellows pump 200 is depressed. The plug hole 243 is sized to provide a minimum desired flow resistance.

The cap 244 is rotatably connected to the plug 242 and a plurality of cap holes 246-250 are formed radially around the cap 244. As the cap 244 is rotated, each cap hole 246-250 can be made to align with the plug hole 243 and provide a path for fluid to pass out of the bellows pump 200 with a resistance inversely proportional to the size of the aligned cap hole 246-250. A protrusion 260 is formed on the cap 244 which allows a person to manually grasp and turn the cap 244 to select the desired resistance.

While a plug 242 and cap 244 combination are used to retrofit an existing bellows pump 200, those skilled in the art will readily recognize that a bellows pump 200 can be provided with the cap 244 already provided, as described, covering an opening 230 in the bellows pump 200.

Figure 10:
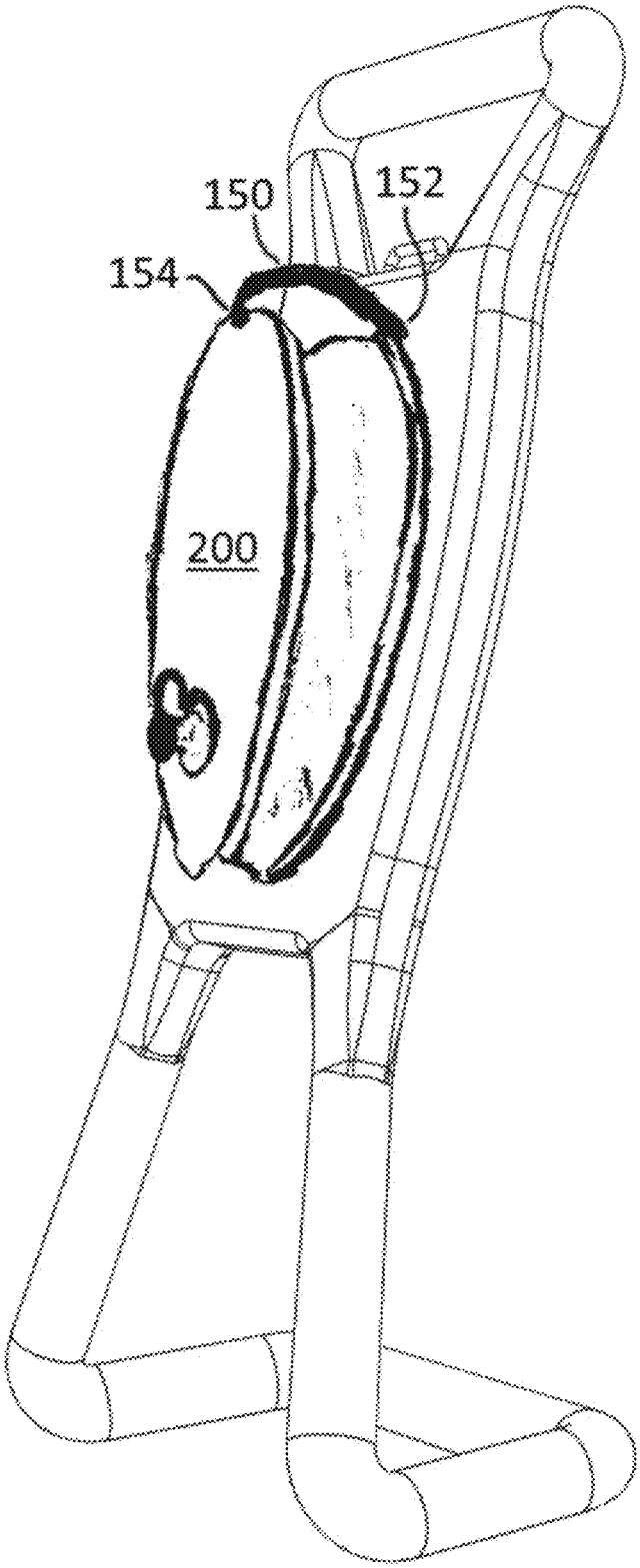
FIG. 10 is a perspective view of exercise device of FIG. 1 showing a clasp used to restrain a bellows of the device in a compressed state.

Referring to FIG. 1 and FIG. 10, a clasp 150 is provided. The clasp 150 includes a first end 152 attached to the body 109 and a second end 154 adapted to releasably engage the bellows pump 200 in a depressed position. When a user is finished exercising, the user depresses the bellows pump 200, pulls the hooked end 154 of the clasp 150 over the bellows pump 200, and releases the bellows pump 200. The hooked end 154 retains the bellows pump 200 in the depressed position so that less storage space is needed.

A non-skid material 202 (shown in FIG. 1) can be applied to the face of the bellows pump 200 to improve traction when a user engages the device 100 with a foot.

As demonstrated in FIG. 11-13, the exercise device 100 can be placed against the wall W and used from various positions, including a standing position (FIG. 11), a crouched position (FIG. 12), or a laying position (FIG. 13). With the exercise device 100 leaned against the wall W, the user places a foot on the bellows pump 200 and depresses the bellows pump 200, then releases the bellows pump 200. This motion is repeated as desired.

It will be further understood that various changes in the details, materials, and arrangements of the parts which have been described and illustrated in order to explain the nature of this invention may be made by those skilled in the art without departing from the scope of the invention as expressed in the following claims.

I claim:

1. A stand for an exercise device comprising:

(a) a planar body;

(b) a first leg extending downwardly from the planar body;

(c) a second leg extending downwardly from the planar body;

(d) a first extension extending upwardly from the planar body;

(e) a second extension extending upwardly from the planar body; and (f) a handle fixedly connecting the first extension and the second extension; wherein the first and second legs extend co-planar with the planar body.

2. The stand according to claim 1, further comprising a U-shaped connector portion having a first arm connected to the first leg, a second arm connected to the second leg, and a connector piece connecting the first arm and the second arm.

3. The stand according to claim 2, wherein the first leg and the first arm form an acute angle.

4. The stand according to claim 2, wherein when the handle engages a vertical surface, the connector piece is spaced away from the vertical surface.

5. The stand according to claim 1, further comprising a clasp extending away from the planar body between the first extension and the second extension.

6. The stand according to claim 1, wherein the planar body includes a central longitudinal axis, and wherein each of the first leg, the second leg, the first extension, and the second extension extends at an acute angle relative to the central longitudinal axis.

7. A stand for an exercise device comprising:

(a) a body;

(b) a first leg extending downwardly from the body;

(c) a second leg extending downwardly from the body;

(d) a first extension extending upwardly from the body;

(e) a second extension extending upwardly from the body;

(f) a U-shaped connector portion having a first arm fixedly and rigidly connected to the first leg at a first acute angle, a second arm fixedly and rigidly connected to the second leg at a second acute angle, and a connector piece connecting the first arm and the second arm.

8. The stand according to claim 7, wherein the first acute angle and the second acute angle have the same value.

9. The stand according to claim 8, wherein the first acute angle and the second acute angle are each 70 degrees.

10. The stand according to claim 7, further comprising a handle connecting the first extension and the second extension.

11. The stand according to claim 10, further comprising a void extending between the first extension and the second extension.

12. The stand according to claim 7, wherein the body includes a central longitudinal axis, and wherein each of the first leg, the second leg, the first extension, and the second extension extends at an acute angle relative to the central longitudinal axis.

13. The stand according to claim 7, further comprising a inverted handle extending from the body between the first extension and the second extension.

14. The stand according to claim 7, wherein the body comprises a planar body.

15. A stand for an exercise device comprising:

(a) a planar body extending along a central longitudinal axis;

(b) a first leg extending downwardly from the planar body;

(c) a second leg extending downwardly from the planar body;

(d) a U-shaped connector portion having a first arm fixedly connected to the first leg at a first acute angle, a second arm fixedly connected to the second leg at a second acute angle, and a connector piece connecting the first arm and the second arm;

(e) a first extension extending upwardly from the planar body;

(f) a second extension extending upwardly from the planar body; and (g) a handle fixedly connecting the first extension and the second extension; wherein the first and second legs extend co-planar with the planar body.

16. The stand according to claim 15, wherein the U-shaped connector is out of the plane of the generally planar body.

17. The stand according to claim 15, wherein each of the first leg, the second leg, the first extension, and the second extension extends at an acute angle relative to the longitudinal axis.

18. The stand according to claim 15, wherein the U-shaped connector portion extends at a third acute angle relative to each of the first leg and the second leg.

* * * * *